United States Patent [19]

Pauza

[11] Patent Number: 4,795,356

[45] Date of Patent: Jan. 3, 1989

[54] ELECTRICAL TAP CONNECTOR ASSEMBLY

[75] Inventor: William V. Pauza, Palmyra, Pa.

[73] Assignee: AMP Incorporated, Harrisburg, Pa.

[21] Appl. No.: 166,292

[22] Filed: Mar. 10, 1988

Related U.S. Application Data

[63] Continuation-in-part of Ser. No. 4,512, Jan. 20, 1987, Pat. No. 4,744,774, and a continuation-in-part of Ser. No. 13,748, Feb. 12, 1987, Pat. No. 4,744,775.

[51] Int. Cl.[4] ..... H01R 17/04

[52] U.S. Cl. ..... 439/225; 439/577; 439/578

[58] Field of Search ..... 439/225, 577–585

[56] References Cited

U.S. PATENT DOCUMENTS

| | | | |
|---|---|---|---|
| 2,791,755 | 5/1957 | Hammell | 339/258 |
| 3,617,983 | 11/1971 | Patton | 339/98 |
| 3,760,335 | 9/1973 | Roberts | 339/99 R |
| 4,126,372 | 11/1978 | Hashimoto et al. | 339/177 E |

*Primary Examiner*—Joseph H. McGlynn

[57] ABSTRACT

A tap connector assembly (210) for coaxial cable networks includes a receptacle tap connector (206) incorporated into the cable network and a plug connector (208) mateable therewith to connect external apparatus into the network. Contacts (219, 322, 323) are adapted to be engaged by terminals (386, 387, 388) in plug connector (208) when plug connector (208) is mated with receptacle tap connector (206) to connect external apparatus into the network. Receptacle tap connector (206) includes normally closed switch means (340) for providing a first signal path between signal carrying contacts (322, 323) when the receptacle tap connector is not in use, and the plug connector (208) includes cam surfaces (405, 406) for opening normally close switch means (340) when the connectors are mated to interrupt the first signal path. The tap connector (206) includes means for defining first and second substantially radially extending, sheath engaging surfaces (253, 293, 294) for clamping an exposed, fanned out portion of conductive sheath (22) therebetween for electrically connecting the conductive sheath to the grounding contact (219).

15 Claims, 5 Drawing Sheets

ELECTRICAL TAP CONNECTOR ASSEMBLY

BACKGROUND OF THE INVENTION

This application is a continuation in part of application Ser. No. 07/004,512, filed Jan. 20, 1987, now U.S. Pat. No. 4,744,774, and a continuation in part of application Ser. No. 07/013,748, filed Feb. 12, 1987, now U.S. Pat. No. 4,744,775.

The present invention relates generally to the field of electrical connectors and, more particularly, to a tap connector assembly for coaxial cable networks.

One expanding use for electrical tap connectors is in the field of premises wiring. Premises wiring typically carries voice, electronic data, and/or electrical power over one or more electrical conductors and/or one or more optical fibers gathered together in a communications cable network. Workstations situated at various locations in the same building or in separate buildings are linked to the cable network by tap connectors; and the network, in turn, links the workstations to one another to receive or transmit data carried by the network.

The communications cable may take various forms. For example, the cable may comprise a twisted pair cable containing insulated wires that are spirally twisted together in pairs. Alternatively, the cable may comprise a coaxial cable containing one or more insulated conductors surrounded by a cylindrical, conductive sheath Optical fiber cables may also contain a sheath surrounding the optical fibers within the cable to provide the cable with physical strength and to provide a shield to protect the fibers. Such a sheath may be electrically conductive to provide for a ground electrical potential along the sheath and along the length of the cable.

Tap connectors for coaxial cable networks were frequently relatively difficult to install and required special tools and skills for proper installation. In addition, many coaxial tap connectors were not effective in maintaining the integrity of the overall network when the connectors were not in use or when external apparatus was being plugged into or disconnected from the network. Furthermore, many coaxial tap connectors were not fully satisfactory with respect to providing reliable electrical connection between the cylindrical conductive sheath of the communications cable and the connector. There is, in fact, a large demand generally for electrical connectors which are capable of effectively clamping the conductive sheath of a communications cable.

U.S. Pat. No. 4,126,372 discloses a known electrical connector that comprises a first cone shaped clamping jaw member having an axial passage for receipt of a coaxial cable. The clamping jaw member has a truncated conical end that tunnels concentrically under a cylindrical conductive sheath, also referred to as an outer conductor, of a coaxial cable. A second clamping jaw member is slidable over the conductive sheath. The first and second clamping jaw members are electrically conductive and clamp the conductive sheath therebetween to establish an electrical connection of the conductive sheath to the connector.

U.S. Pat. No 4,126,372 discloses that the cylindrical conductive sheath of a coaxial cable may be flared outwardly or folded back in order to permit two conductive clamping jaw members to clamp the sheath therebetween. The clamping jaw members are formed with inclined wedge shapes which conform to either the flared or folded back shape of the sheath.

The conductive clamping jaw members of the apparatus disclosed in U.S. Pat. No. 4,126,372 are fabricated from thick metal parts having sufficient mass to withstand the clamping forces The members are fabricated by manufacturing procedures which involve separately machining the members. Machining operations are capable of producing parts having precise dimensions and tolerances. However, the rate at which the parts are produced is slow, and the cost of their manufacture is relatively high. Machining operations, accordingly, are only suitable for producing parts in small quantities or when the need for high precision justifies a more costly manufacturing technique.

The large demand for tap connectors and for other connectors which are capable of clamping the outer conductive sheath of a communications cable has spurred efforts to reduce the cost of such connectors, either by improving manufacturing techniques or by redesigning the connectors to eliminate the need for costly manufacturing techniques. A further reduction in cost can be realized if the connectors are designed for field application, defined as assembly of the connectors to cables at locations where the cables are installed for use. An even further cost reduction can be obtained if the connectors are capable of being assembled to cables by untrained workers without the need for special tools.

Connectors having parts fabricated from stamped and formed metal strip are significantly less costly than connectors having machined parts. An electrical connector having clamping jaws fabricated with stamped and formed metal strip and being sufficiently rugged to withstand the clamping forces applied by the jaws to the outer conductive sheath of a cable would be a highly desirable product.

SUMMARY OF THE INVENTION

According to one aspect of the present invention, a tap connector assembly for electrical cable networks is provided which comprises a tap connector connected to the cable network, and a mating connector mateable with the tap connector to connect external apparatus into the cable network.

The tap connector includes a connector housing; first and second signal carrying contacts carried by the housing and adapted to be electrically connected to first and second conductors, respectively; normally closed switch means for electrically connecting the first and second signal carrying contacts for providing a first signal path between the first and second signal carrying contacts, the normally closed switch means including a movable switch arm attached to each of the first and second signal carrying contacts and adapted to normally engage the other of the signal carrying contacts for normally providing the first signal path between the first and second signal carrying contacts; a third grounding contact carried by the housing and adapted to be connected to conductive sheaths of one or both of the first and second conductors; and receiving means on the housing for receiving a mating connector, whereby the first, second, and third contacts are engaged by terminals on the mating connector when the mating connector is received by the receiving means for providing electrical connection of the first and second signal carrying contacts and of the third grounding contact with the terminals on the mating connector, and for establishing a second signal path between the first and second signal carrying contacts through the mating connector, the movable switch arms being adapted to be displaced from the other of the signal carrying contacts in a direction generally parallel to the direction of movement of the mating connector by cam surfaces on the mating connector during mating of the connector with the tap connector to open the normally closed switch means for interrupting the first signal path whereby only the second signal path through the mating connector is provided between the first and second signal carrying contacts when the mating connector is received by the receiving means.

With the tap connector of the invention, the normally closed switch means provides a first signal path between the first and second signal carrying contacts and between the first and second conductors connected thereto to maintain the integrity of the cable network when the tap connector is not in use. When the mating connector is mated with the tap connector, however, a second signal path is established between the first and second signal carrying contacts through the mating connector; and the normally closed switch means is opened to interrupt the first signal path, thus providing a series connection with the cable network of apparatus connected by the mating connector.

Preferably, the tap connector comprises a receptacle tap connector; the mating connector comprises a plug connector; and the mating connector receiving means comprises a cavity in the receptacle tap connector for receiving the plug connector. During mating of the plug and receptacle connectors, first and second terminals in the plug connector engage the first and second signal carrying contacts in the receptacle tap connector, momentarily creating a dual signal path between the first and second signal carrying contacts. Further insertion of the plug connector into the cavity in the receptacle tap connector causes the cam surfaces on the plug connector to engage the movable switch arms of each signal carrying contact, separating them from the opposite signal carrying contact leaving only the second signal path through the plug connector connected in the network. With the connector assembly of the invention, accordingly, the first signal path is not broken until after the second signal path is established. Similarly, when the plug connector is disconnected from the receptacle tap connector, the cam surfaces on the plug connector release the movable switch arms, allowing the switch means to close and reestablish the first signal path prior to disconnection of the second signal path. Thus, with the present invention, network integrity is maintained at all times.

According to a presently preferred embodiment of the invention, the first and second signal carrying contacts are identical and interchangeable in the connector permitting a reduction in both inventory requirements and manufacturing costs. In addition, the movable switch arms are designed to be moved by the cam surfaces on the plug connector in a direction substantially parallel to the direction of movement of the plug connector for more reliable operation of the normally closed switch means when the plug connector is mated with or disconnected from the tap connector. Also, the inclusion of two movable switch arms in the normally closed switch means provides a redundancy in the switch means for even greater operating reliability.

The receptacle tap connector of the invention is designed to be easily assembled and incorporated into a cable network without specialized tools or skills. In particular, the receptacle tap connector includes a plastic housing, a grounding contact supported by the housing, first and second fitting assemblies for attaching the first and second conductors to opposite ends of the housing, and a signal carrying contact assembly containing first and second insulation displacement, signal carrying contacts and the switch means. Usually, the tap connector will be used to connect first and second coaxial electrical cables into the cable network and the first and second fitting assemblies each includes structure for defining a first sheath engaging or clamping surface, and the grounding contact includes a pair of disk shaped portions defining second sheath engaging or clamping surfaces.

To assemble the receptacle tap connector to a cable network, the first and second cables are extended through central apertures in the first and second fitting assemblies, respectively Exposed portions of the outer conductive sheaths of the first and second cables are then fanned out against the first sheath engaging surfaces of the first and second fitting assemblies. The fitting assemblies are then attached to the housing to clamp the conductive sheaths of the first and second cables between the first clamping surfaces on the fitting assemblies and the second clamping surfaces on the grounding contact to electrically connect the conductive sheaths of the first and second cables to the grounding contact. The signal carrying conductors of the first and second cables, surrounded by inner dielectric sheaths, extend into the housing when the fittings are attached to the housing. The signal carrying contact assembly is then mounted to the housing, causing the first and second insulation displacement, signal carrying contacts to pierce the inner dielectric sheaths of the cables to electrically connect the contacts to the signal carrying conductors of the cables and complete the assembly.

In another application, the tap connector is used to terminate a cable network, and in such application, the second fitting assembly comprises a network terminator containing a conductor attached to a resistor for preventing unwanted reflections back into the circuit.

An important aspect of the tap connector assembly of the present invention is the inclusion of clamping means which effectively secures the outer conductive sheath of a communications cable to the connector for establishing a reliable electrical connection between the outer conductive sheath and the connector. In accordance with this aspect of the invention, an electrical connector for an electrical cable having a conductive sheath surrounding at least one electrical conductor is provided which comprises, first and second clamping members having corresponding passageways, the clamping members having corresponding sheath engaging surfaces, the clamping members being constructed for attachment to each other with the passageways aligned for receiving at least one conductor of an electrical cable, and with the sheath engaging surfaces opposing each other for clamping a conductive sheath of an electrical cable, which conductive sheath extends radially relative to an axis of the cable, the improvement comprising wherein the sheath engaging surfaces are substantially disk shaped with at least one of the sheath engaging surfaces being constructed to bow outwardly toward the other and to flatten upon clamping a conductive sheath of an electrical cable and to recover by spring action to maintain a conductive sheath clamped by the sheath engaging surfaces notwithstanding limited movement apart of the sheath engaging surfaces.

According to a presently preferred embodiment, the first clamping member comprises an insulative fitting having a radial surface which defines the first sheath engaging surface, and the second clamping member comprises an electrically conductive grounding contact in a connector housing. A cable having a conductive outer sheath and one or more center conductors is extended through the passageway in the fitting, and an exposed portion of the outer, conductive sheath of the cable is flared outwardly at substantially right angles to the axis of the cable so as to be positioned between the sheath engaging surfaces of the fitting and the grounding contact. Thereafter, when the first and second clamping members are clamped together, for example, by threading the fitting onto the connector housing, the exposed conductive sheath will be firmly clamped between the two sheath engaging surfaces to establish electrical contact between the conductive sheath of the cable and the grounding contact in the connector. The one or more center conductors of the cable continue through the passageway in the grounding contact to be connected to center conductor connection means such as electrical contact means in the connector.

The sheath engaging surface of the grounding contact is bowed outwardly toward the sheath engaging surface on the fitting such that it is able to collapse in a fashion similar to a Belleville washer, recovering as necessary through spring action to compensate for movement of the fitting relative to the housing as a result of plastic creep. The bowed, sheath engaging surface is also preferably of radially segmented construction to further help overcome any tendency of plastic creep between the housing and the fitting.

In general, the present invention provides an electrical connector having clamping means for reliably securing the outer conductive sheath of a cable to the connector that can be manufactured in large quantities at low cost. Assembly of the connector and of the cable to the connector can be made in the factory or in the field by unskilled personnel using ordinary tools such as a knife and a pair of pliers. The fitting can be attached to the housing by hand without the use of tools.

Further features and advantages of the invention will become apparent hereinafter in conjunction with the following detailed description of a presently preferred embodiment.

DETAILED DESCRIPTION OF THE PREFERRED EMBODIMENT

Figure 1:
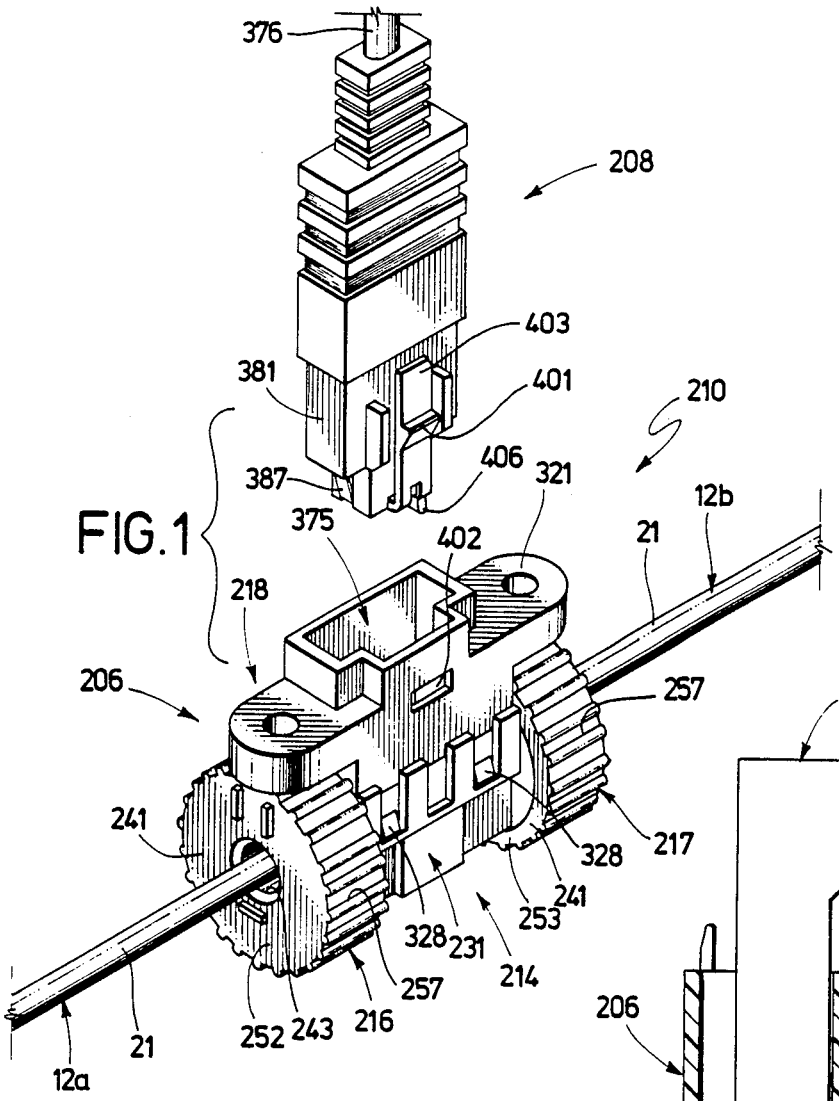
FIG. 1 is a perspective view of a tap connector assembly according to a presently preferred embodiment of the invention.

FIGS. 1–4 illustrate an electrical tap connector assembly according to a presently preferred embodiment of the invention. The connector assembly is generally designated by reference numeral 210 and includes a receptacle tap connector 206 adapted to be incorporated into an electrical cable network, and a plug connector 208 mateable therewith to connect external apparatus into the cable network. The connector assembly is particularly designed to provide access to a premises wiring system although it should be understood that it is not intended to restrict the invention to any particular application.

Figure 2:
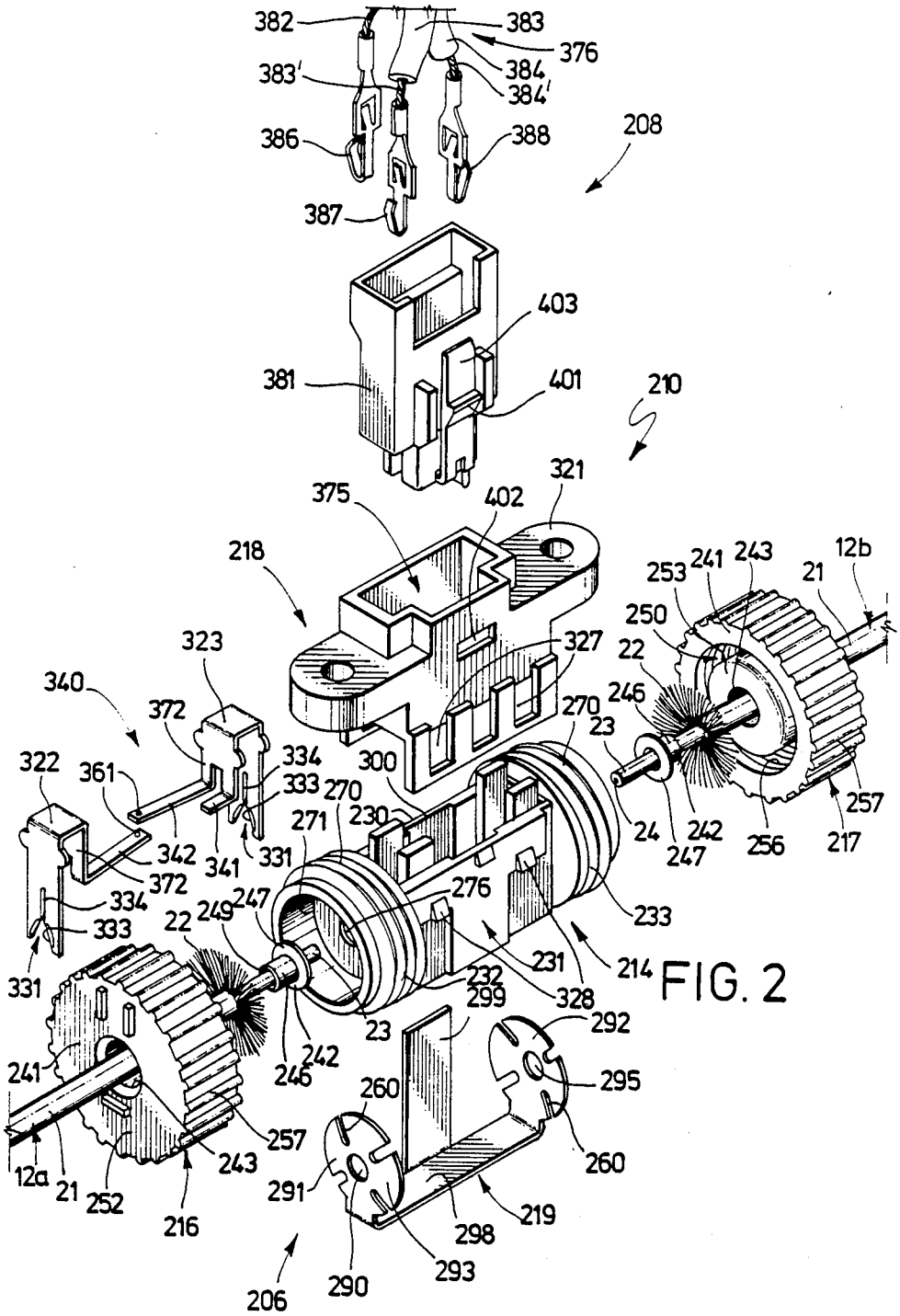
FIG. 2 is a partially exploded, perspective view of the tap connector assembly of FIG. 1.
Figure 3:
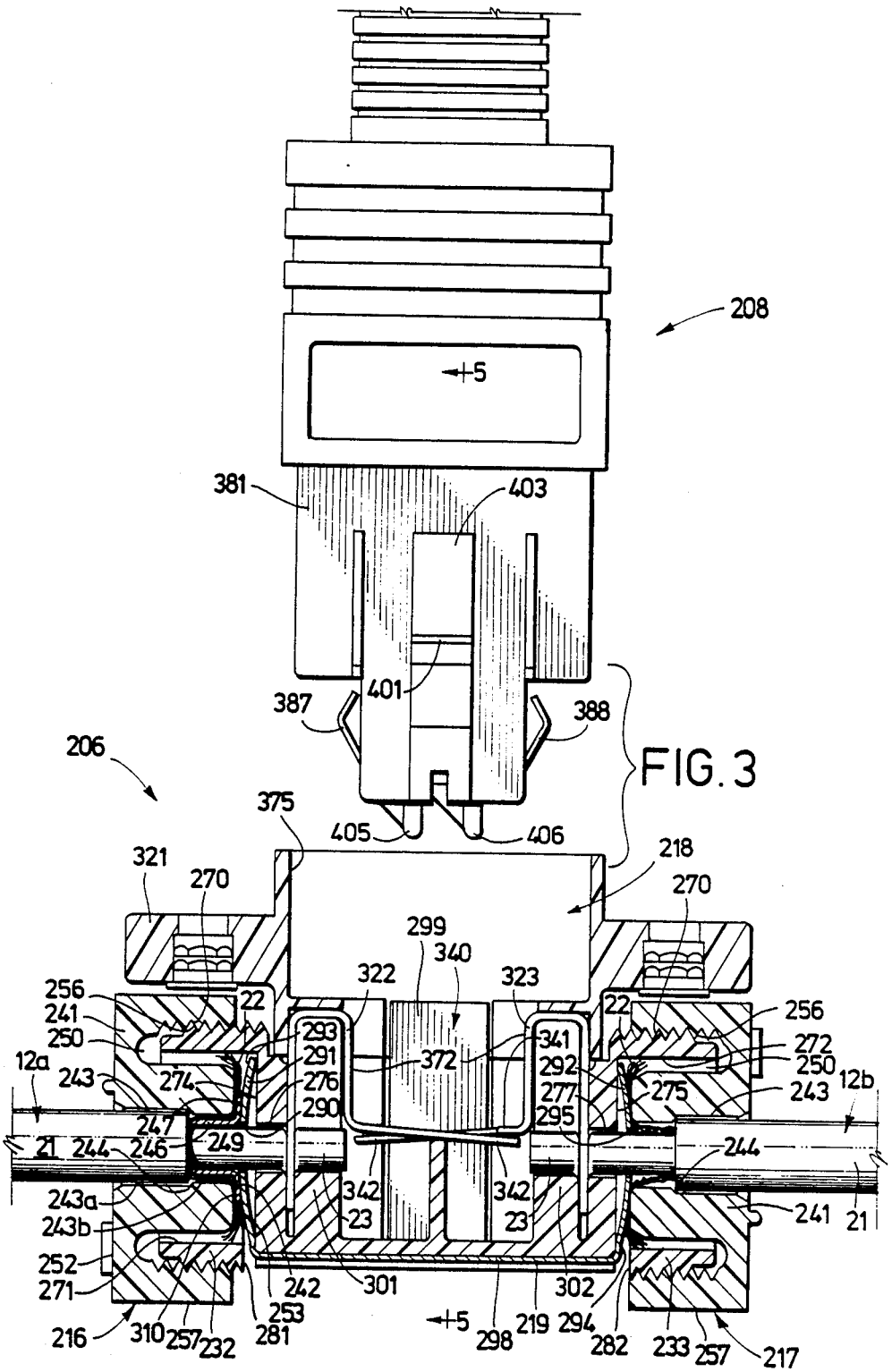
FIGS. 3 and 4 are partial cross sectional views of the tap connector assembly of FIGS. 1 and 2 in unmated and mated condition, respectively, with FIG. 4 additionally illustrating a modification of the tap connector.
Figure 4:
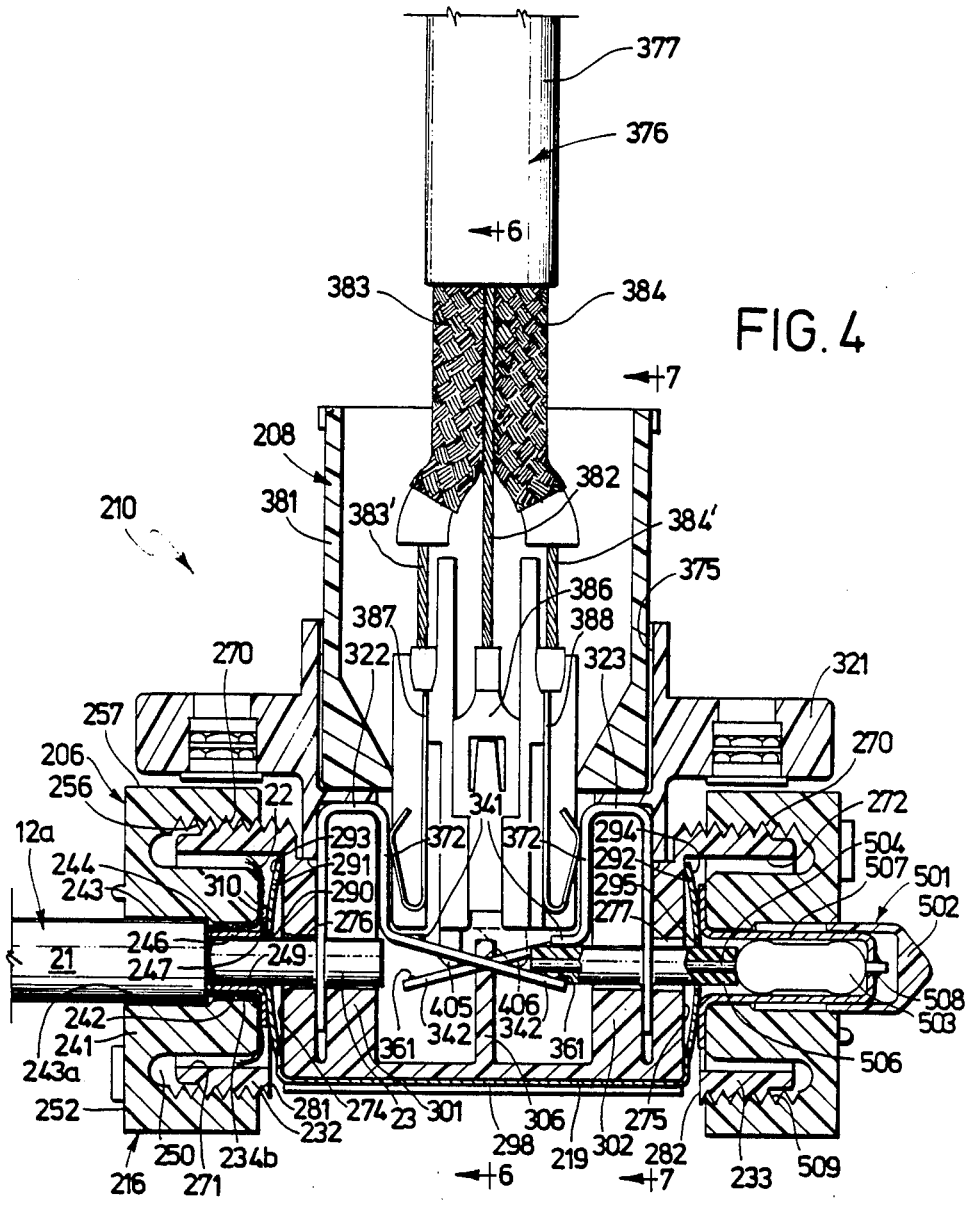

Receptacle tap connector 206 is normally used to connect two cables **12*a* and 12*b* in the cable network. As shown in FIGS. 2–4, cables 12*a* and 12*b* include an outer jacket 21 of polymeric, insulative material coaxially and concentrically surrounding an electrically conductive grounding sheath 22. Electrically conductive sheath 22, in turn, surrounds an insulative sheath 23 which contains the one or more transmission lines of the cables. The transmission lines can include one or more electrical conductors and/or one or more optical fiber conductors. In the embodiment described herein, the cables comprise coaxial cables carrying a single, signal carrying electrical center conductor 24 axially within the conductive outer sheath 22**.

Receptacle tap connector 206 is illustrated in detail in FIGS. 2–4 and is designed to be easily assembled and installed into a cable network without specialized tools or skills. Generally, receptacle tap connector 206 includes housing assembly 214, a pair of fitting assemblies 216 and 217, and a signal carrying contact assembly 218. Housing assembly 214 will be described in greater detail hereinafter, but generally comprises an elongated, molded plastic housing 230 having a central cavity portion 231 for receiving and supporting signal carrying contact assembly 218 and a grounding contact 219, and a pair of end portions 232 and 233 for receiving and supporting fitting assemblies 216 and 217, respectively, when the connector is assembled. End portions 232 and 233 are externally threaded as shown at 270.

Fitting assemblies 216 and 217 are identical, and the same reference numerals are used herein to describe their construction. Each fitting assembly comprises a molde plastic, bolt shaped fitting 241, and, optionally, an eyelet 242 which is adapted to be assembled thereto. Fitting 241 has a central passageway 243 extending axially therethrough, and an internal shoulder 244 of the passageway divides the passageway into first passageway portion **243*a* and second, reduced diameter, passageway portion 243*b*. Eyelet 242 comprises a relatively thin, metal member shaped to define a sleeve portion 246 and a flange portion 247. The eyelet has a central opening 249 passing therethrough which is adapted to be aligned with passageway 243 in fitting 241 when the two components are assembled by extending sleeve portion 246 of eyelet 242 into passageway 243 as shown in FIGS. 3 and 4** and as will be explained more fully hereinafter.

Fitting assemblies 216 and 217 comprise clamping members and are adapted to receive the ends of cables **12*a* and 12*b*, respectively. Prior to insertion of the cables into the fittings, the cables are prepared by cutting and stripping off a length of their outer dielectric jacket 21 to expose a portion of braided, conductive sheath 22** therein. A lesser portion of the conductive sheath is also removed to expose inner dielectric sheath 23. The cables so prepared are then inserted into and through passageways 243 of fittings 241 from ends 252 thereof. Insertion of the cables is limited by impingement of their outer jackets 21 against internal shoulders 244 of the passageways; however, conductive sheaths 22, dielectric sheaths 23, and center conductors 24 pass fully through passageways 243. Exposed conductive outer sheaths 22, after being passed through the fitting assemblies, are then fanned out, as shown in FIGS. 2–4, over radially extending inner surfaces 253 of the fittings. As will be explained hereinafter, surfaces 253 function as first sheath engaging surfaces or clamping surfaces for clamping the conductive sheaths to receptacle connector 206.

Each of the fittings 241 includes an inner, threaded surface portion 256 for engagement with housing assembly 214 and an external fluted surface portion 257 to provide an enhanced gripping surface to assist the worker in insertion of the fitting assemblies onto the housing assembly.

If desired, an eyelet 242 can be inserted into the passageway 243 of each fitting after the conductive outer sheaths of the cables are fanned out over surfaces 253 of the fittings. Eyelet 242 is adapted to be inserted into passageway 243 of a fitting until the outer flange 247 thereof impinges against the surface 253 of the fitting and against the fanned out outer sheath of the cable. Eyelet 242 helps to more smoothly fan out the outer conductive sheath of the cable and provides the cable with additional tensile strength making it more difficult for the cable to be accidentally pulled out of the connector. Use of the eyelet is optional, however, as shown in FIG. 3 wherein fitting assembly 216 includes an eyelet and fitting assembly 217 does not have an eyelet. When an eyelet is inserted into a fitting, the center conductor 24 of the cable and its insulative sheath 23 is extended through the central opening 249 of the eyelet.

Fitting assemblies 216 and 217 are adapted to be secured to end portions 232 and 233, respectively, of housing 230. End portions 232 and 233 define recesses or cavities 271 and 272, having back walls 274 and 275, respectively, having small central apertures 276 and 277, respectively, therein for receiving center conductors 24 of the cables and their insulative sheaths 23, as shown in FIGS. 3 and 4. The housing is molded from an insulative plastic to define narrow slots 281 and 282 extending into cavities 271 and 272, respectively, adjacent back walls 274 and 275 thereof. These slots are adapted to receive disk like portions 291 and 292 of grounding contact 219. Outer surfaces 293 and 294 of disk like portions 291 and 292, respectively, alone or in conjunction with the surface of eyelets 242 define second sheath engaging surfaces or clamping surfaces to be clamped against first sheath engaging surfaces 253 on fittings 241 to clamp the fanned out portions of outer conductive sheaths 22 therebetween when fitting assemblies 216 and 217 are mounted to housing assembly 214. Disk like portions 291 and 292 include central apertures 290 and 295 for receipt of center conductors 24 and their insulative sheaths 23 when the cables are extended into housing assembly 214.

As shown in the Figures, disk like portions 291 and 292 of grounding contact 219 are of domed, resilient spring configuration to provide stored spring energy to compensate for any creep characteristics of the plastic components when fitting assemblies 216 and 217 are screwed onto ends 232 and 233 of housing 219. In addition, the disk like portions are provided with a plurality of radial slots 260 (see FIG. 2) to segment the disk like portions to further increase the stored spring energy of the disk like portions for even greater reliability. The grounding contact also includes a central strip 298 connecting the disk like ends 291 and 292 and a center ground bar 299 positioned at right angles along one side of the strip.

To assemble receptacle connector 206, grounding contact 219 is first inserted into housing 230. When it is inserted into housing 230, domed, disk like portions 291 and 292 extend into slots 281 and 282, respectively, such that disk like portions 291 and 292 are positioned within cavities 271 and 272 adjacent back walls 274 and 275 thereof. Center ground bar 299 extends through a slot 300 formed in the side of housing 230 (FIG. 2). Small, inwardly extending flanges adjacent the bottom of the sides of the housing 230 are cold formed, for example, by impact of a tool against the housing to cause spreading of some material of the housing to overlap the grounding contact 219. The flanges help to retain the grounding contact in the housing and to resist movement of the grounding contact when engaged by the plug connector 208. Fitting assemblies 216 and 217, having the ends of cables **12*a* and 12*b*, respectively, attached thereto, are then threaded onto ends 232 and 233 of housing 230. Fanned out portions of the braided outer sheaths 22 are sandwiched between first sheath engaging surfaces 253 on plastic fittings 241 encircling the holes 243 and second sheath engaging surfaces defined by surfaces 293 and 294 on disk like portions 291 and 292 either alone or in conjunction with the inner surfaces 310 of eyelets 242 if the eyelets are used in the connector. As the fitting assemblies are screwed onto the housing, domed disk like portions 291 and 292 collapse in a fashion similar to a Belleville washer and are capable of recovering through spring action to an extent necessary to compensate for movement due to plastic creep of the threaded plastic elements. The conductive sheaths of the cables are thus firmly clamped to the connector and electrically connected to grounding contact 219** therein.

As best shown in FIGS. 3 and 4, each fitting 241 is formed to define an annular recess or cavity 250 extending inwardly from the clamping surface 253 thereof. Recess 250 functions to receive any excess portions of the conductive sheath when the fitting is screwed onto the housing to ensure that the sheath is retained fully within the connector and to reduce tolerance requirements when preparing the cable.

During threading of fitting assemblies 216 and 217 onto housing 230, dielectric covered, but unshielded, signal carrying, center conductors 24 of cables **12*a* and 12*b* pass through apertures 290 and 295 in disk like portions 291 and 292 of the grounding contact and into central cavity portion 231 of housing 230. The covered center conductors pass over U shaped rib structures 301 and 302 formed in central portion 231 which support the covered center conductors and function as anvils for connection of the center conductors to signal carrying contact members as will be explained below. A centrally located wall 306 extends across central cavity portion 231** and serves as a stop and a dielectric barrier to ensure that the center conductors entering the central portion of the housing from the opposite ends do not inadvertently contact one another. Housing assembly 214 is now ready to receive signal carrying contact assembly 218.

Signal carrying contact assembly 218 comprises a contact housing 321 of molded plastic and a pair of signal carrying contacts 322 and 323 supported within the housing.

Figure 7:
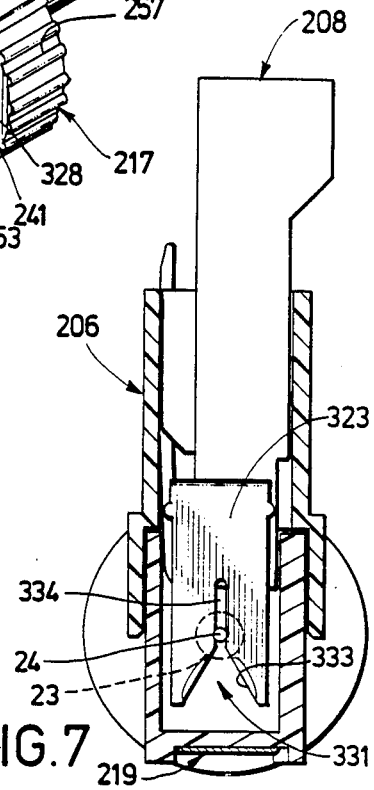
FIG. 7 is a cross sectional view of the tap connector assembly of FIGS. 1–6 in mated condition looking in the direction of arrow 7—7 in FIG. 4.

Signal carrying contacts 322 and 323 are identical and each includes depending U shaped portions which define slots 331 for receiving the exposed insulating layers 23 of cables 12*a* and 12*b*. Tapered areas 333 on the bottom of each slot guide insulating layers 23 into the slots, and edges thereon comprise cutting edges for cutting through insulation layers 23 when contact assembly 218 is inserted into housing 230 to provide direct electrical contact between center conductors 24 of cables 12*a* and 12*b* and contacts 322 and 323, respectively. Ween contact assembly 218 is fully inserted into housing 230, center conductors 24 extend through narrow slot portions 334 of slots 331 to firmly clamp conductors 24 and reliably establish electrical contact between the contacts and the center conductors (see FIG. 7). Insulation displacement contacts of the type utilized herein are known in the art and are disclosed, for example in U.S. Pat. No. 3,617,983.

A second depending portion 372 of contacts 322 and 323 is integrally provided with a pair of generally horizontally extending arms thereon including a first, relatively short, stationary contact arm 341 and a second, relatively long, movable contact arm 342. As shown in FIGS. 3 and 4, when contacts 322 and 323 are positioned in housing 321, the movable arm 342 of each contact is aligned with the stationary arm of tee other contact.

The contact arms define normally closed switch means 340, and are adapted to provide a first signal path between signal carrying contacts 322 and 323 and, hence, between signal carrying conductors 24 of cables 12*a* and 12*b*.

Movable switch arms 342 ar preferably formed to be in a preloaded condition such that when they are installed in the contact housing, they will be somewhat flexed to ensure reliable electrical connection of the switch arms. Switch arms 342 preferably also include embossment features 361 near their outer tips to further ensure a reliable contact.

Figure 5:
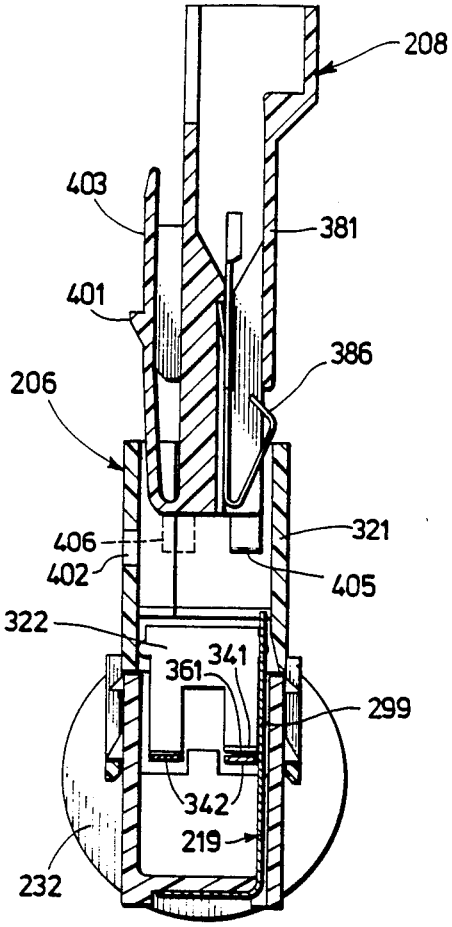
FIGS. 5 and 6 are cross sectional views of the tap connector assembly of FIGS. 1–4 in unmated and mated condition, respectively, looking in the direction of arrows 5—5 and 6—6 in FIGS. 3 and 4, respectively.
Figure 6:
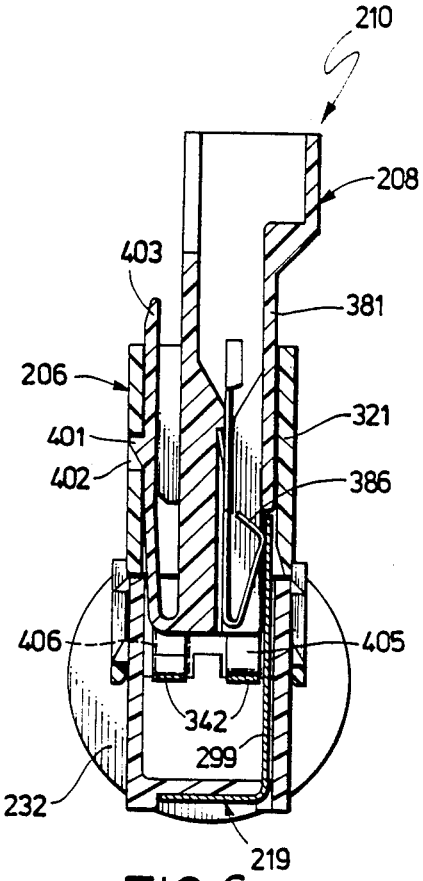

Insulation displacement connection occurs when signal carrying contact housing assembly 218 is inserted into the central cavity portion of connector housing 230. During insertion of contact assembly 218, the center conductors of the cables are received within tapered areas 333 of slots 331 of the contacts. During continued insertion, the cutting edges on areas 333 cut through protective sheaths 23 of the cables and allow the thus exposed center conductors of the cables to pass into narrow portions 334 of the slots to electrically connect the center conductors to the contacts. Anvils 301 and 302 in connector housing 230 and molded portions in signal carrying contact housing 321 provide backup support during cutting of the insulative layer of the cable. The size of narrow slot portions 334 are such as to firmly and reliably retain center conductor wires 24 therein. When the signal carrying contact housing is inserted into the connector housing, center ground bar 299 of grounding contact 219 is received within the signal carrying contact housing as best illustrated in FIGS. 5 and 6.

Signal carrying contact housing 321 includes latching features 327 to cooperate with latching features 328 on housing 230 to secure contact assembly 318 within connector housing 230.

When signal carrying contact assembly 218 is inserted into housing assembly 214, assembly of receptacle tap connector 206 and its connection to cables 12*a* and 12*b* is completed. When the receptacle tap connector is not being used to tap into the cable network, switch arms 341 and 342 are in contact; and switch means 340 is closed as shown in FIG. 3 to provide a first signal path within the receptacle tap connector housing between signal carrying contacts 322 and 323 and, hence, between center conductors 24 of cables 12*a* and 12*b*. Similarly, the outer conductive sheaths of cables 12*a* and 12*b* are connected to grounding contact 219.

To tap into the cable network, plug connector 208 is inserted into recess or cavity 375 within signal carrying contact housing 321 of receptacle tap connector 206. Plug connector 208 is connected to an electrical cable 376 having an outer insulative sheath or jacket 377, a pair of insulation covered, signal carrying conductors 383 and 384, and a third ground conductor 382. Signal carrying conductors 383 and 384 include corresponding conductive portions 383', 384' connected to conductive terminals 387 and 388. Ground conductor 382 is connected to conductive terminal 386. Terminals 386, 387 and 388 are mounted on external surfaces of an insulative housing 381 of plug 208 and are oriented on housing 381 to face, respectively, ground bar 299 of grounding contact 219 and signal carrying contacts 322 and 323. At least a portion of plug 208 and terminals 386, 387, 388 are constructed for removable insertion into plug receiving opening or recess 375 of contact housing 321. Upon said insertion, housing 381 of plug 208 urges terminal 386 to engage compressibly and slideably impinge ground bar 299 to establish an electrical connection of ground conductor 382 to conductive sheaths 22 of cables 12*a* and 12*b* (see FIGS. 5 and 6). Also upon said insertion, housing 381 of plug 208 urges terminals 387 and 388 to engage compressibly and slideably impinge, respectively, depending portions 372 of signal carrying contacts 322 and 323 to establish a second signal path between the first and second signal carrying contacts through plug 208 (see FIG. 4).

Plug connector 208 includes a latching member 401 which is adapted to engage a latching feature 402 in contact housing 218 when the plug connector is inserted into the receptacle connector to retain the connectors in mated condition (see FIGS. 1 and 2). Latch 401 includes an extended finger portion 403 to readily permit the plug connector to be disconnected from the receptacle connector when desired.

Plug connector housing 381 is configured to define cam surfaces 405 and 406 (see FIGS. 3 and 4) on the lower surface thereof which are positioned to engage movable switch arms 342 of the signal carrying contacts 322 and 323 during mating of the connectors and to push them downwardly out of contact with stationary switch arms 341 to interrupt the first signal path between signal carrying contacts 322 and 323. More particularly, during mating of the connectors, ground connection is first made between grounding contact center bar 299 and grounding contact terminal 386 on the plug connector to connect the conductive sheaths in cables 12*a* and 12*b* to grounding cable 382. Further insertion of the plug connector into cavity 375 causes signal carrying contacts 387 and 388 on the plug connector to engage depending portions 372 on contacts 322 and 323, momentarily creating a dual signal path through both the normally closed switch means 340 and the the plug connector. Further insertion and bottoming of the plug connector, however, causes cam surfaces 405 and 406 to move movable switch arms 342 down and out of engagement with stationary switch arms 341, thereby opening switch means 140 and leaving only a series connection from the cables 12*a* and 12*b* through the plug connector into workstation apparatus (not shown) connected to the plug connector. Of course, if and when the plug connector is disconnected from the receptacle connector, movable switch arms 342 are released by cam surfaces 405 and 406 and automatically return back into contact with switch arms 341 to close switch means 340 and reestablish the first signal path between signal carrying contacts 322 and 323.

In the connector of FIGS. 1–7, signal carrying contacts 341 and 342 are identical and interchangeable permitting a reduction in both manufacturing costs and inventory requirements. Also, the switch means formed by the contacts, by having two movable switch arms, is designed to provide a dual connection between the contacts thus providing greater reliability in operation. In addition, when the plug connector is inserted into the tap connector to tap into the network, the cam surfaces 405 and 406 opens the switch means by moving the movable contacts in a direction parallel to the direction of movement of the plug connector for even greater reliability.

FIG. 4 illustrates a modification of the tap connector assembly of the present invention for use when the tap connector assembly is adapted to terminate a network line rather than connect two cables 12*a* and 12*b* in the line. Specifically, if only a single cable 12*a* is connected to the tap connector 206, it is desirable to mount a terminator 501 to the opposite end of the connector housing to replace the missing cable 12*b*. Terminator 501 comprises a plastic fitting 502 which supports a 50 ohm resister 503. A conductor wire 504 is connected to the resister and is surrounded by a thin tube 506 of teflon or the like to protect and support the wire. An electrically conductive eyelet 507 is mounted in a central aperture of the fitting and is soldered to the resister as shown at 508. As shown, fitting 502 is internally threaded at 509. and is sized so as to be threadable onto the end 233 of tap housing 214 to replace fitting 217.

With the terminator attached to the tap connector housing, when the signal carrying contact assembly 218 is mounted to the housing, the signal carrying contact 323 will pierce through tube 506 and conductor wire 504 will enter into narrow slot 334 thereof to electrically connect the resistor to the contact 323 through the wire. The resistor provides a termination for the connector and for the cable network to help prevent reflections back into the circuit.

With the present invention a tap connector assembly is provided which maintains network integrity at all times. The assembly includes a receptacle tap connector mountable to a coaxial cable network which provides a first electrical signal path between two cables when the tap is not in use. The assembly also includes a plug connector mateable with the receptacle tap connector, which, when mated, interrupts the first signal path after establishing a second signal path between the two cables through the plug connector and external apparatus connected thereby to establish a series connection of the external apparatus into the network.

The connector assembly is manufactured primarily from stamped and formed metal strip and molded plastic rather than machined, precision made parts resulting in a connector that is of lower cost and capable of high volume production.

While what has been described constitutes a presently preferred embodiment of the invention, it should be understood that the invention can take numerous other forms. Accordingly, it should be understood that the invention should be limited only insofar as is required by the scope of the following claims.

I claim:

1. A tap connector for coaxial cable networks, comprising:

a connector housing;

first and second signal carrying contacts carried by said connector housing and adapted to be electrically connected to first and second conductors, respectively;

normally closed switch means for electrically connecting said first and second signal carrying contacts for providing a first signal path between said first and second signal carrying contacts, said normally closed switch means including a movable switch arm attached to each of said first and second signal carrying contacts and adapted to normally engage the other of said signal carrying contacts for normally providing said first signal path between said first and second signal carrying contacts;

a third grounding contact carried by said housing and adapted to be connected to conductive sheaths of one or both of said first and second conductors; and receiving means on said housing for receiving a mating connector, whereby said first, second and third contacts are engaged by terminals on said mating connector when said mating connector is received by said receiving means for providing electrical connection of said first and second signal carrying contacts and of said third grounding contact with said terminals on said mating connector, and for establishing a second signal path between said first and second signal carrying contacts through said mating connector, said movable switch arms being adapted to be displaced from the other of said signal carrying contacts in a direction generally parallel to the direction of movement of said mating connector by cam surfaces on said mating connector during mating of said mating connector with said tap connector to open said normally closed switch means for interrupting said first signal path whereby only said second signal path through said mating connector is provided between said first and second signal carrying contacts when said mating connector is received by said receiving means.

2. The tap connector of claim 1 wherein said normally closed switch means further includes a stationary switch arm attached to each of said first and second signal carrying contacts and adapted to normally be engaged by the movable switch arm attached to the other signal carrying contact for providing said first signal path between said first and second signal carrying contacts.

3. The tap connector of claim 1 wherein said first and second signal carrying contacts are substantially identical and are interchangeable in said tap connector.

4. The tap connector of claim 1 wherein said first and second signal carrying contacts comprise insulation displacement contacts.

5. The tap connector of claim 1 and further including first and second fittings adapted to be attached to said housing for attaching said first and second conductors to said tap connector.

6. The tap connector of claim 5 wherein said tap connector is adapted to connect first and second coaxial cables of said cable network, said first and second conductors comprising signal carrying conductors of said first and second cables, respectively, and wherein said first and second fittings are adapted to attach said first and second cables to said tap connector.

7. The tap connector of claim 5 wherein said tap connector is adapted to terminate said cable network said first conductor comprises a signal carrying conductor of an electrical cable and said second conductor comprises a conductive wire terminated by a resistor, said first fitting being adapted to attach said electrical cable to said tap connector and said second fitting being adapted to attach said conductive wire terminated by said resistor to said tap connector.

8. The tap connector of claim 7 wherein said conductive wire and said resistor are supported by said second fitting and wherein said second signal carrying contact is adapted to be connected to said conductive wire to terminate said cable network.

9. The tap connector of claim 8 wherein said second fitting is threadedly attached to said housing.

10. In an electrical connector for an electrical cable having a conductive sheath surrounding at least one electrical conductor, the connector comprising, first and second clamping members having corresponding passageways, the clamping members having corresponding sheath engaging surfaces, the clamping members being constructed for attachment to each other with the passageways aligned for receiving at least one conductor of an electrical cable, and with the sheath engaging surfaces opposing each other for clamping a conductive sheath of an electrical cable, which conductive sheath extends radially relative to an axis of the cable, the improvement comprising;

the sheath engaging surfaces are substantially disk shaped with at least one of the sheath engaging surfaces being constructed to bow outwardly toward the other and to flatten upon clamping a conductive sheath of an electrical cable and to recover by spring action to maintain a conductive sheath clamped by the sheath engaging surfaces notwithstanding limited movement apart of the sheath engaging surfaces.

11. In an electrical connector as recited in claim 10, the improvement further comprising;

a housing of the second clamping member, and conductive means in said housing for electrical connection to a corresponding electrical conductor of an electrical cable.

12. In an electrical connector as recited in claim 10, the improvement further comprising;

the sheath engaging surface of the first clamping member is on an insulative portion of said first clamping member.

13. In an electrical connector as recited in claim 12 wherein said first clamping member includes an annular cavity extending inwardly from said sheath engaging surface thereof for receiving excess portions of said radially extending conductive sheath when said conductive sheath is clamped by said sheath engaging surfaces.

14. In an electrical connector as recited in claim 12, the improvement further comprising; the first clamping member includes an eyelet extending into the passageway of the first clamping member, said eyelet including a radially extending flange portion for securing said conductive sheath between said sheath engaging surface of said first clamping member and said eyelet for providing strain relief for said electrical cable.

15. In an electrical connector as recited in claim 10, the improvement further comprising;

said outwardly bowed sheath engaging surface is radially segmented for further maintaining a conductive sheath clamped by the sheath engaging surfaces notwithstanding limited movement apart of the sheath engaging surfaces.

* * * * *